US008931303B2

(12) United States Patent
Toyoshima et al.

(10) Patent No.: US 8,931,303 B2
(45) Date of Patent: Jan. 13, 2015

(54) REFRIGERATING AIR-CONDITIONING APPARATUS

(75) Inventors: Masaki Toyoshima, Tokyo (JP); Susumu Yoshimura, Tokyo (JP); Shinichi Wakamoto, Tokyo (JP); Osamu Morimoto, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/219,346

(22) Filed: Aug. 26, 2011

(65) Prior Publication Data

US 2011/0308273 A1 Dec. 22, 2011

Related U.S. Application Data

(62) Division of application No. 11/922,503, filed as application No. PCT/JP2006/306300 on May 9, 2006, now abandoned.

(30) Foreign Application Priority Data

Oct. 6, 2005 (JP) ..... 2005-293643

(51) Int. Cl.
*F25B 43/02* (2006.01)
*F25B 43/00* (2006.01)
(Continued)

(52) U.S. Cl.
CPC ..... *F25B 43/006* (2013.01); *F25B 31/004* (2013.01); *F25B 13/00* (2013.01); *F25B 47/00* (2013.01); *F25B 2313/006* (2013.01); *F25B 2400/02* (2013.01)
USPC ..... 62/471; 62/468; 62/470; 62/472; 62/473; 62/474; 62/475

(58) Field of Classification Search
USPC ..... 62/471–475, 468
See application file for complete search history.

(56) References Cited

U.S. PATENT DOCUMENTS 1,899,378 A * 2/1933 Zouck et al. ..... 62/83
2,975,613 A * 3/1961 Heidorn ..... 62/192
(Continued)

FOREIGN PATENT DOCUMENTS

GB 455177 10/1936
JP 06-147658 A 5/1994
(Continued)

OTHER PUBLICATIONS

Mizuno, Machine translation of JP 2004-069101, "Accumulator, Air Conditioning Equipment With Accumulator, and Its Operating Method", 4.3.2004., PAJ, all.*
(Continued)

*Primary Examiner* — Allen Flanigan
*Assistant Examiner* — Filip Zec
(74) *Attorney, Agent, or Firm* — Buchanan Ingersoll & Rooney PC

(57) ABSTRACT

A refrigerating air-conditioning apparatus, at least provided with no possibility that a foreign material returns to a compressor from an accumulator at a time of the pipeline-cleaning operation firstly, and provided with a possibility to perform a collecting operation for the foreign material in a short time secondary, is provided.
The heat-source side unit includes an accumulator provided with a function to separate and collect the foreign material in an existing pipeline, a collecting container for collecting the foreign material separated by the accumulator, and an oil return pipeline for returning refrigerating machine oil to the compressor via a flow amount adjusting device, installed at a lower portion of the accumulator, and at a time of ordinary cooling or heating operation, the refrigerating machine oil is caused to flow into the oil return pipeline, and at a time of pipeline cleaning and foreign material-collecting operations, the flow amount adjusting device is fully closed.

8 Claims, 4 Drawing Sheets

(51) Int. Cl.

| | |
|---|---|
| ***F25B 31/00*** | (2006.01) |
| *F25B 13/00* | (2006.01) |
| *F25B 47/00* | (2006.01) |

(56) References Cited

U.S. PATENT DOCUMENTS

| | | | | | |
|---|---|---|---|---|---|
| 3,283,532 | A | | 11/1966 | Kocher | |
| 3,850,009 | A | | 11/1974 | Villadsen | |
| 3,945,216 | A | | 3/1976 | Schibbye | |
| 4,193,520 | A | | 3/1980 | Duffield | |
| 4,249,389 | A | * | 2/1981 | Mayer | 62/192 |
| 4,588,000 | A | * | 5/1986 | Malin et al. | 141/1 |
| 5,161,385 | A | * | 11/1992 | Schumacher | 62/127 |
| 5,301,520 | A | | 4/1994 | Kitamura et al. | |
| 5,396,776 | A | | 3/1995 | Kim | |
| 5,444,987 | A | | 8/1995 | Alsenz | |
| 5,875,640 | A | * | 3/1999 | Hill | 62/192 |
| 6,250,099 | B1 | | 6/2001 | Furuya et al. | |
| 6,484,526 | B2 | | 11/2002 | Terry | |
| 6,510,698 | B2 | | 1/2003 | Kasai et al. | |
| 6,516,628 | B2 | * | 2/2003 | Izawa et al. | 62/509 |
| 6,662,576 | B1 | | 12/2003 | Bai | |
| 2001/0011778 | A1 | | 8/2001 | Batterham et al. | |
| 2005/0081537 | A1 | * | 4/2005 | Hwang et al. | 62/84 |

FOREIGN PATENT DOCUMENTS

| | | | |
|---|---|---|---|
| JP | 3002520 | U | 7/1994 |
| JP | 09-152202 | A | 6/1997 |
| JP | 11-108506 | | 4/1999 |
| JP | 2000-074506 | | 3/2000 |
| JP | 2000-179952 | A | 6/2000 |
| JP | 2001-263871 | A | 9/2001 |
| JP | 2002-228306 | A | 8/2002 |
| JP | 2003-156258 | A | 5/2003 |
| JP | 3431552 | B2 | 5/2003 |
| JP | 2003-302127 | A | 10/2003 |
| JP | 2004-069101 | A | 3/2004 |
| JP | 2004-085037 | A | 3/2004 |
| JP | 2004-097995 | A | 4/2004 |
| JP | 2004-219016 | A | 8/2004 |
| JP | 2005-043025 | A | 2/2005 |

OTHER PUBLICATIONS

International Search Report for PCT/JP2006/309300 dated Aug. 15, 2006.

Supplementary European Search Report issued in the corresponding European Application No. 06746131.9-1266 dated Jun. 7, 2010.

Office Action from Japanese Patent Office issued in Applicant's corresponding Japanese Patent Application No. 2005-293643 dated Sep. 7, 2010, and English translation thereof.

Partial European Search Report dated May 31, 2011, issued in the corresponding European Patent Application No. 10016039.9-1266.

Extended European Search Report issued Jul. 27, 2011 in the corresponding European Patent Application No. 10016039.9.

Mizuno et al., Accumulator, Air Conditioning Equipment With Accumulator, and Its Operating Method, Mar. 4, 2004, PAJ, 2004-069101, all.

Yoshimi et al., Refrigeration Unit, Oct. 24, 2003, PAJ, 2003-302127, all.

* cited by examiner

REFRIGERATING AIR-CONDITIONING APPARATUS

TECHNICAL FIELD

The present invention relates to an air-conditioning apparatus constructed by means of connecting a heat-source side unit and a load-side unit using an existing refrigerant pipeline, and particularly, to a technology for separating foreign material mainly including used freezing machine oil as a main component, which is collected from a pipeline by cleaning thereof, and for collecting the same into a collecting container.

BACKGROUND ART

In performing a pipeline-cleaning operation with an aim to reuse an existing pipeline in replacing a refrigerating air-conditioning machine, there is a need to separate and collect residual material such as mineral oil, so as to prevent the residual material mainly including mineral oil having been existing in the existing pipeline, which is collected by means of the pipeline-cleaning operation, from flowing into a newly-constructed refrigerant circuit, by returning to a compressor. This is because refrigerating machine oil such as the mineral oil, having been used for CFC (Chloro Floro Carbon) or HCFC (Hydro Chloro Floro Carbon), containing chlorine, before the replacement, is not compatible with new refrigerant HFC series (Hydro Floro Carbon) not containing the chlorine, after the replacement, or the like, and when a great volume of used refrigerating machine oil remains in a refrigerating cycle in the form of residues, the same results in a foreign material (contamination), and there is a possibility that problems such as damaging of the compressor occurs.

Consequently, hitherto, a technology for separating and collecting the foreign material (mainly used refrigerating machine oil) collected in the pipeline-cleaning operation is developed, and as an example, there is a technology in which an accumulator is used as a separating device for separating a refrigerant and the foreign material, and the separated and collected foreign material is collected in a collecting container provided below the accumulator (for example, refer to the patent document 1). Further, as a technology for collecting separated and collected foreign material into a collecting container using an accumulator as a separating device for a refrigerant and the foreign material, there is a technology in which a pipeline for degassing a collecting container is connected to an outlet pipe of an accumulator to increase an oil collecting speed, so that an increase of a suction effect by an extent of a pressure loss difference of the pipeline is utilized (for example, refer to the patent documents, 2, 3, and 4).

Patent Document 1: Japanese Unexamined Patent Application Publication No. 2003-302127 (FIG. 1, and FIG. 2), Patent Document 2: Japanese Unexamined Patent Application Publication No. 2004-069101 (FIG. 1, and FIG. 3), Patent Document 3: Japanese Unexamined Patent Application Publication No. 2004-085037 (FIG. 1, and FIG. 2), and Patent Document 4: Japanese Unexamined Patent Application Publication No. 2004-219016 (FIG. 1, and FIG. 2)

DISCLOSURE OF INVENTION

Problems to be Solved by the Invention

Hitherto, since a U-shaped pipe having a hole for an oil return at a lower part of an outlet pipe of an accumulator, as a separating device, is used, in a case that a large volume of foreign material or a liquid-refrigerant returns to the accumulator on start-up or the like, there has been a possibility that the foreign material returns to a compressor via the hole of the U-shaped pipe.

Further, in a method using an accumulator including a build-in U-shaped pipe having a hole for oil return disposed at a lower part of an outlet pipe, serving as a hitherto known separating device, the outlet pipeline of the accumulator is provided two in number, and a motor valve is provided in the middle of the pipeline at a side where the U-shaped pipe and the compressor are connected, and by means of closing the valve at a time of performing a pipeline-cleaning operation, it is prevented that the foreign material returns to the compressor via the hole of the U-shaped pipe even in a case that the large volume of foreign material or a liquid refrigerant returns to the accumulator on start-up or the like. However, there have been disadvantages such as that an electromagnetic valve corresponding to a suction pipeline having such a large bore diameter as ϕ28.7, or the like is expensive, and there is a possibility that when a large valve is provided in a pipeline directly connected to the compressor, the pipeline breaks due to vibration, and so forth.

Further, since the foreign material is accumulated up to a height position of an oil return hole in the U-shaped pipe, the foreign material cannot be removed even when the aforementioned electromagnetic valve is closed, there has been a problem that when returning to an ordinary operation by opening the valve after the pipeline-cleaning operation is performed, the residual foreign material returns to the compressor. In general, a suction pipeline of the compressor including the U-shaped pipe has a large bore diameter (ϕ28.6 mm, or the like), and a capacity of a portion lower than the height of the oil return hole is large, and there has been a possibility that a large volume of foreign material such as a volume that cannot be disregarded returns to the compressor.

Furthermore, in the technology for collecting the foreign material collected in the accumulator into a collecting container utilizing the hitherto known accumulator as a separating and collecting container, the collecting container is installed below the accumulator as a driving force for a collecting operation for the foreign material, and only a head difference thereof is utilized. However, due to a limit of installing space in a heat source machine unit, there have been problems that it is difficult to largely take a head difference, suction force is weak, it takes great amount of time for a collecting operation, and a construction efficiency becomes bad. Particularly, when ambient air temperature is low in a season of heating, since a degree of oil viscosity rises along temperature lowering of oil as a main component of the foreign material, a tendency thereof has significantly appeared. As to the viscosity of the oil, the viscosity has a tendency to rapidly rise corresponding to the temperature lowering.

Moreover, in the technology for collecting the foreign material collected in the accumulator into the collecting container utilizing the hitherto known accumulator as the separating and collecting container, an outlet side of an accumulator (suction side of a compressor) is connected to a degassing pipe of a collecting container so as to increase the suction force for performing a collecting operation for the foreign material. Accordingly, there has been a possibility that a great amount of foreign material in the collecting container overflows and returns to the compressor. In addition, although a float valve, an observation window, or the like is provided so as to prevent the problem, any of them is expensive and there has been a possibility that the mineral oil returns to the compressor while overflowing at a time of a mal-operation of the float valve.

Further, in the technology for collecting the foreign material collected in the accumulator into the collecting container utilizing the hitherto known accumulator as the separating and collecting container, the collecting container doubles as a container for replenishing oil for a new refrigerant, and is used for replenishing the oil for the new refrigerant that has flowed out in a pipeline-cleaning operation, while previously enclosing the oil for the new refrigerant in the collecting container. However in this method, since the collecting operation for the foreign material cannot be performed until the replenishing operation for the oil for the new refrigerant is completed, there has been problems such as that when the oil viscosity rises at the time when the ambient air temperature is low, it requires great amount of time for replenishing the oil for use in the new refrigerant, resulting in taking long entire process time, and thereby the construction efficiency becomes bad.

The present invention is made for solving the problems as described above, and an object is at least to provide a refrigerating air-conditioning apparatus in which firstly, there is no possibility that the foreign material returns to the compressor from the accumulator at a time when a pipeline-cleaning operation is performed, and secondly, it is permitted to collect the foreign material in a short time.

Means for Solving the Problems

According to the present invention, in a refrigerating air-conditioner in which a heat-source side unit and a load-side unit are connected by means of an existing refrigerant pipeline, the aforementioned heat-source side unit includes an accumulator provided with a function for separating and collecting a foreign material in the existing pipeline, and a collecting container for collecting the foreign material separated by means of the aforementioned accumulator, an oil return pipeline for returning the refrigerating machine oil to a compressor via a flowing amount adjusting device is provided below the aforementioned accumulator, wherein at a time of ordinary cooling or heating operation, the refrigerating machine oil is caused to flow into the aforementioned oil return pipeline, and at time of a pipeline-cleaning operation or a foreign material-collecting operation, the aforementioned flowing amount adjusting device is fully closed.

Advantages

In the present invention, in an air-conditioner in which a heat-source side unit and a load-side unit are connected by means of an existing refrigerant pipeline, the heat-source side unit includes an accumulator for separating and collecting a foreign material in the existing pipeline, and a collecting container for collecting the foreign material separated by means of the accumulator, an oil return pipeline for returning the foreign material to a compressor via a flowing amount adjusting device is provided below the accumulator, wherein at a time of ordinary cooling or heating operation, an oil return circuit is opened, and at a time of a pipeline-cleaning operation or a foreign material-collecting operation, the same is closed. Thereby, at the time of pipeline-cleaning operation, the foreign material is not returned to the compressor from the accumulator, and there is no possibility that the foreign material is commingled with the new refrigerating machine oil, and the foreign material-collecting operation is assuredly performed.

REFERENCE NUMERALS

1: compressor, 2: four-way valve, 3: heat-source side heat exchange device, 4: liquid-side ball valve, 5*a* and 5*b*: pressure-adjusting valve, 6*a* and 6*b*: load-side heat exchange device, 7: gas-side ball valve, 8: accumulator, 8*a*: accumulator inlet pipe, 8*b*: accumulator outlet pipe, 9: collecting container, 10: oil separator, 11: oil tank, 12: pressure-adjusting valve, 13: liquid refrigerant pipeline, 14: gas refrigerant pipeline, 15*a*, 15*b*, and 15*c*: electromagnetic valve, 16: pressure sensor, 17: temperature sensor, 18*a*: capillary tube for oil return, 21*a*, and 21*b*, flow amount-adjusting valve, 22*a* and 22*b*: ball valve, 23: pressure escape valve, 24*a*: collecting pipeline, 24*b*: oil return pipeline, 25: degassing pipe, 26: interflow portion of degassing pipe, 27: front suction pipe of accumulator, 28: rear suction pipe of accumulator, 30: bypass electromagnetic valve, 100: heat-source side unit, 110: foreign material-collecting device, 200: load-side unit.

Best Mode For Carrying Out The Invention

Figure 1:
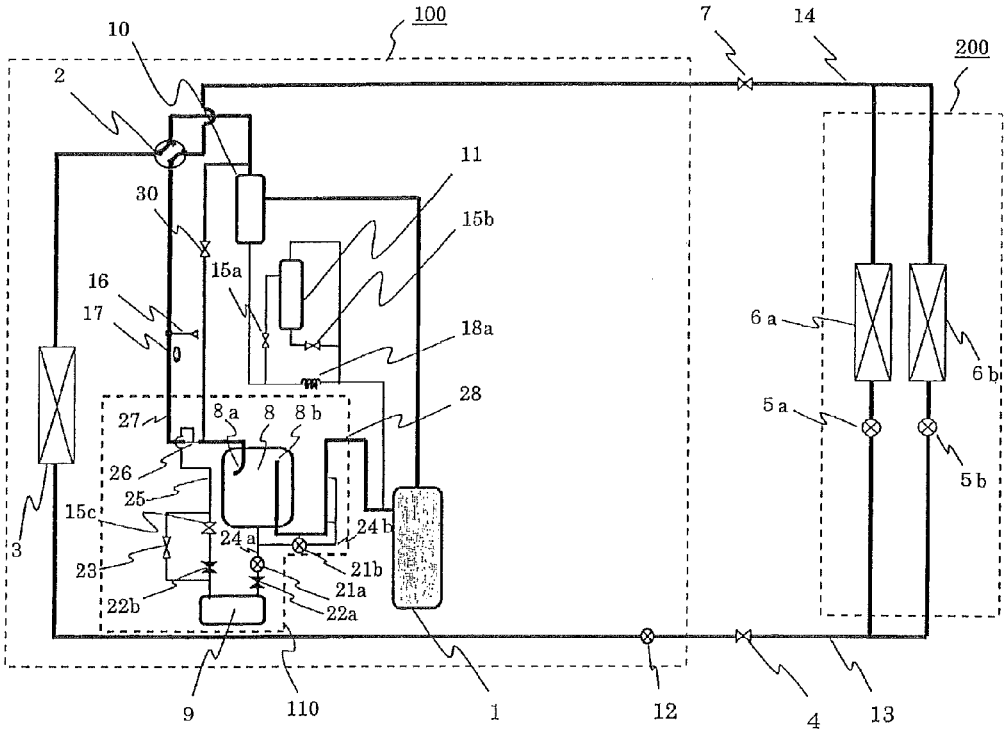
FIG. 1 is a view of a refrigerant circuit of a refrigerating air-conditioning apparatus according to a first embodiment with respect to the present invention.

FIG. 1 is a view showing a refrigerant circuit construction of a refrigerating air-conditioning apparatus according to the first embodiment with respect to the present invention. In FIG. 1, a heat-source side unit 100 is provided with an accumulator 8, a compressor 1, an oil separator 10, a four-way valve 2, a heat-source side heat exchange device 3 and a pressure-adjusting valve 12, and constructs a main circuit of the heat-source side unit 100 by connecting the same in the order. Further, the load-side unit 200 is composed of throttling devices, 5*a* and 5*b*, and load-side heat exchange devices, 6*a* and 6*b*, and the heat-source side unit 100 and the load-side unit 200 are connected by means of an existing liquid-refrigerant pipeline 13, an existing gas refrigerant pipeline 14, and a liquid-side ball valve 4 and a gas-side ball valve 7.

Furthermore, the heat-source side unit 100 includes a pressure sensor 16 provided at a low pressure portion, and a temperature sensor 17 for measuring a temperature of a position in front of the accumulator 8, at a suction side of the compressor 1. By means of providing the pressure sensor and the temperature sensor at positions of the numerals 16 and 17 in the drawing, it becomes possible to detect a superheat of the refrigerant at an inlet of the accumulator 8. At this moment, the reason why the position of the temperature sensor 17 is determined to be on the inlet side of the accumulator 8 is to control the superheat of the refrigerant at the inlet of the accumulator 8, and to realize an operation in which the liquid refrigerant does not return to the accumulator 8 (described later in detail). Incidentally, the position of the pressure sensor 16 is not limited to the position shown in the drawing, and may be provided at any place if the position is in a zone from the four-way valve 2 to a suction side of the compressor 1.

Furthermore, the heat-source side unit 100 is provided with an oil tank 11, and at a portion above the oil tank 11, a pipeline in which the refrigerant circuit between a lower portion of the oil separator 10 and a capillary tube for oil return 18*a* is branched is connected. Another portion above the oil tank 11 is connected to a suction pipeline of the compressor with a pipeline. Moreover, from a portion below the oil tank 11, the oil tank is connected to a pipeline connected between the capillary tube for oil return 18*a* and the suction pipeline of the compressor via the electromagnetic valve 15*b*. Moreover, an outlet side of the oil separator 10 and an inlet side of the accumulator 8 are connected via the bypass electromagnetic valve 30, and by means of opening the bypass electromagnetic valve 30, the gas at high temperature and high pressure in the compressor 1 can be introduced to a portion in front of the accumulator 8. Incidentally, although a connecting portion at the high-pressure side of the bypass circuit is positioned at the outlet side of the oil separator 10 in FIG. 1, the same may be connected to a portion in front of the oil separator 10.

Next, a construction of a foreign material-collecting device 110 housed in the heat-source side unit 100 will be explained. Incidentally, the foreign material in the present embodiment mainly refers to used refrigerating machine oil, and hereinafter the foreign material collectively means the used refrigerating machine oil and a residual foreign material in the existing pipeline. The foreign material-collecting device 110 is constructed with the accumulator 8, a collecting container 9, a pipeline or a type of valves accompanying the same, and the accumulator 8 functions as a foreign material-separating device, and the accumulated foreign material is collected into the collecting container 9.

In the accumulator 8, an inlet pipe (accumulator inlet pipe 8*a*) and an outlet pipe (accumulator outlet pipe 8*b*) of a main refrigerant circuit are connected thereto. An opening portion of the accumulator inlet pipe 8*a* is positioned at an upper part of the accumulator 8, and an outlet of the pipe is bent so as to face in a horizontal direction of a pipe wall surface so that inflow gas forms a flow along a horizontal direction, or slightly downward direction relative to the horizontal direction of the wall surface. An opening portion of the accumulator outlet pipe 8*b* is positioned at an upper part of the accumulator 8, and is constructed such that the accumulator outlet pipe 8*b* does not directly suck down liquid unless great amount of the liquid is accumulated in the accumulator 8. At a bottom portion of the accumulator 8, a collecting pipeline 24*a* for collecting the foreign material accumulated in the accumulator 8, and an oil return pipeline 24*b* for returning oil to the compressor 1 at a time of ordinary cooling or heating operations are connected. The collecting pipeline 24*a* is connected to an upper part of the collecting container 9 via a flow amount-adjusting valve 21*a* and a ball valve 22*a*. The collecting container 9 is provided below the accumulator 8, and a vertical positional relationship between a bottom surface of the accumulator 8 and the collecting container 9 is set such that the bottom surface of the accumulator 8 is configured to be at a position higher than a portion to which the collecting pipe 24*a* is connected, in an upper end of the collecting container 9. Thereby, it becomes possible to utilize a head difference when performing a collecting operation for the foreign material, and a collecting speed can be made rapid.

The oil return pipeline 24*b* is connected to a rear suction pipe of accumulator 28 between the accumulator 8 and the compressor 1 via a flow amount-adjusting valve 21*b*. The oil return pipeline 24*b* is branched into two, and is connected to the rear suction pipe of accumulator 28 at two portions of above and below. The reason is to correspond to a variation of liquid surface height of the accumulator 8. Since the liquid surface is low in an ordinal condition, the oil is returned through a lower connecting pipeline. However, the oil is also returned from a connecting pipeline positioned above when the liquid surface is transiently raised up. Thereby, it becomes possible to correspond to a need for returning the oil to the compressor 1 earlier, by increasing an oil return speed, when great amount of oil is accumulated in the accumulator 8.

The collecting pipeline 24*a* and the oil return pipeline 24*b* are the pipelines for causing the liquid to flow and are formed to be narrower than a main refrigerant pipe. In addition, since the collecting container 9 is installed downwardly in a vertical direction, there is no possibility that the foreign material is accumulated in the pipeline and remains at a main refrigerant circuit side, when the collecting operation for the foreign material is performed. Further, in a part from a portion at which the oil return pipeline 24*b* is branched from the collecting pipeline 24*a* up to a portion where the oil return pipeline reaches the flow amount-adjusting valve 21*b*, there is no accumulating portion such as a trap, and a branching portion is installed downwardly in the vertical direction. Therefore, there is also no possibility that a foreign material is accumulated in this part and that the foreign material returns to the compressor 1 after a foreign material-collecting operation.

At an upper part of the collecting container 9, a degassing pipe 25 for sucking down the foreign material at the time of collecting operation for the foreign material is provided, and the degassing pipe 25 is connected to a front suction pipe of accumulator 27 via a ball valve 22*b* and an electromagnetic valve 15*c*. Further, in the degassing pipe 25, a pressure escape valve 23 is connected in parallel therewith in a manner so as to make a detour for the ball valve 22*b* and the electromagnetic valve 15*c*. The pressure escape valve 23 has a structure to let out pressure while appropriately opening in a case that an internal pressure of the collecting container 9 rises and it prevents the internal portion of the collecting container 9 from resulting in extraordinary high pressure, and thereby being damaged.

Figure 2:
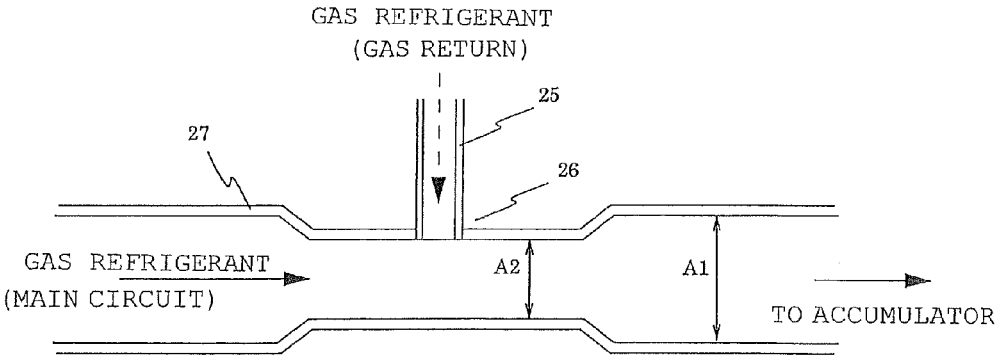
FIG. 2 is a detailed cross-section (axial direction) of a gas-returning portion of an oil-collecting device according to the first embodiment with respect to the present invention.
Figure 3:
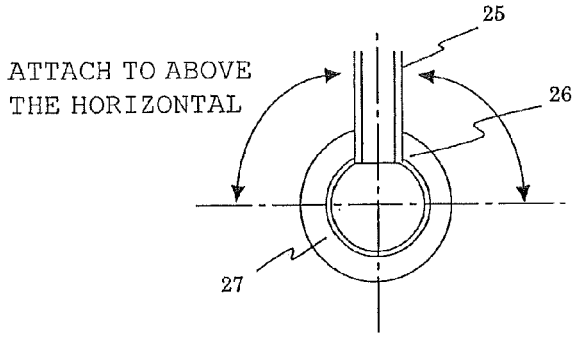
FIG. 3 is a detailed cross-section (radial direction) of the gas-returning portion of the oil-collecting device according to the first embodiment with respect to the present invention.

At this moment, constructions of the degassing pipe 25, the front suction pipe of accumulator 27 and the interflow portion of degassing pipe 26 will be explained using FIG. 2 and FIG. 3. FIG. 2 is a detailed cross-section of a gas-returning portion of a foreign material-collecting device 110 looking from an axial direction, and FIG. 3 is a detailed cross-section of the gas-returning portion of the foreign material-collecting device 110 looking from a radial direction at a center cross-section of the degassing pipe 25 (sometimes called as gas-returning pipe because the same returns the gas in the collecting container 9 to a low-pressure side main refrigerant circuit). As shown in FIG. 2, the portion to which the degassing pipe 25 of the front suction pipe of accumulator 27 is connected is constructed to have an inner diameter smaller than the inner diameter of the pipeline at the back and forth thereof. According to Bernoulli's theorem (formula 1) as a hydraulic theorem, a total of a pressure head, a velocity head, and a potential head is constant, and when the variation is only that in a horizontal direction as shown in FIG. 2, the potential head has no variation and can be disregarded.

$$\frac{P}{\rho g} + \frac{V^2}{2g} + H = \text{constant} \quad \text{[Formula 1]}$$

At this moment, the static pressure is defined as, P[Pa], the current velocity is defined as, V[m/s], the potential head is defined as, H[m], the density is defined as, ρ[kg/m$^3$], and the gravitational acceleration is defined as, g [m/s$^2$].

By means of throttling the inner diameter of the pipeline of a portion to be connected as shown in FIG. 2, a cross-section area A is reduced at the throttled portion and the current velocity V in the pipe rises.

$$V = \frac{G}{\rho A} \quad \text{[Formula 2]}$$

At this moment, the mass flow rate is defined as, G[kg/s] and the cross-section area is defined as, A[m$^2$].

Accordingly, the dynamic pressure rises at the throttled portion, and according to Bernoulli's theorem (formula 1), the pressure head (i.e., static pressure) is lowered by a rising extent of the velocity head (i.e., dynamical pressure). As a result, by a lowering extent of the static pressure at the throttled portion, the static pressure at a degassing pipe 25 side of the collecting container 9 is lowered and thereby suction force for sucking down to the front suction pipe of accumulator 27 is increased. As for the suction force-increasing effect, since a velocity-varying amount by throttling is greater at an area having a large refrigerant circulating amount, namely a current velocity in a pipe than that in the other, the effect outstandingly appears. On the other hand, since a pressure loss is increased, resulting in lowering of the refrigerant circulating amount when a part of the suction pipeline of a compressor is throttled, a throttling rate of the throttled portion cannot be enormously increased. The throttling rate is determined within a range where a bad influence is not applied to a capability.

In the present embodiment, since a length of a portion, at which the pipeline is throttled, is set to be as small as possible, as only in the vicinity of the interflow portion of degassing pipe 26, when a throttling amount is appropriate, (for example, an area ratio of about 60 to 90%), a deterioration of the capability due to the pressure loss does not practically occur.

Further, as shown in FIG. 2 and FIG. 3, the degassing pipe 25 is connected at an angle from the horizontal to a vertical relative to the front suction pipe of accumulator 27, namely at a position higher than the horizontal. Thereby, when the liquid-refrigerant transiently flows in the front suction pipe of accumulator 27, the liquid-refrigerant is prevented from flowing down to the collecting container 9 through the degassing pipe 25.

Next, a principle of operation of the foreign material-collecting operation will be explained on the basis of FIG. 4.

Figure 4:
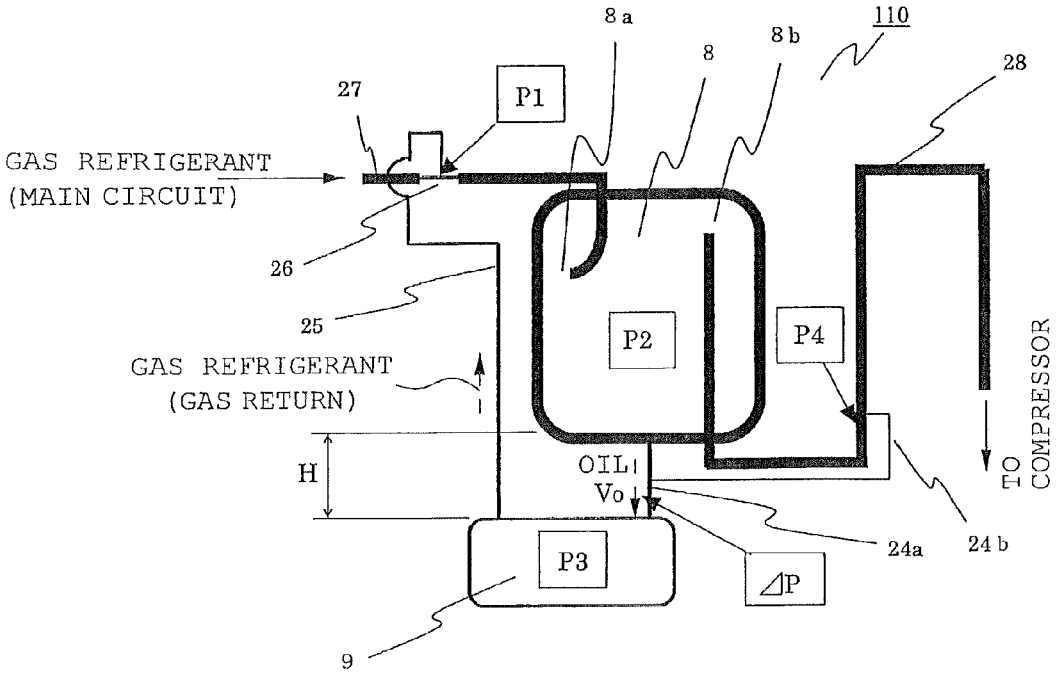
FIG. 4 is an explanatory view of the oil-collecting device according to the first embodiment with respect to the present invention.

FIG. 4 is an enlarged view of the foreign material-collecting device 110 composed of the accumulator 8 and the collecting container 9 in FIG. 1. Incidentally, types of valves which do not have direct relationship with an explanation of the principle of the foreign material are omitted in FIG. 4.

In FIG. 4, the head difference from the upper end of the collecting container 9 to a bottom surface of the accumulator 8 (a height of a flow path where a liquid foreign material flows) is defined as, H[m], a static pressure in the interflow portion of degassing pipe 26 is defined as, P1[Pa], a static pressure in the accumulator 8 is defined as, P2[Pa], a static pressure in the collecting container 9 is defined as, P3[Pa], and a static pressure at an interflow portion of the oil return pipeline 24*b* and the rear suction pipe of accumulator 28 is defined as, P4[Pa]. In addition, a current velocity of oil flowing in the collecting pipeline 24*a* is defined as, $V_0$[m/s], and a pressure loss of the collecting pipeline 24*a* is defined as, ΔP[pa]. Incidentally, in a pressure loss of a pipeline in a collecting circuit from a bottom surface of the accumulator 8 serving as a circuit for collecting the foreign material to the interflow portion of degassing pipe 26, a problem is a pressure loss of the collecting pipeline 24*a* where the oil having high viscosity as a main component of the foreign material flows. A pressure loss of the degassing pipe 25 where only a gas refrigerant having low viscosity, although having the same flowing amount as that of the above described, flows is small as can be relatively disregarded because the flowing amount is small, and therefore is treated as P1≈P3 here for simplification and is explained.

When the upper end of the collecting container 9 is set to be a basis of the height, the formula (3) is led from Bernoulli's theorem.

$$\frac{P2}{\rho g} + H = \frac{P3}{\rho g} + \frac{V_o^2}{2g} + \Delta P \quad \text{[Formula 3]}$$

When the formula (3) is modified, the formula (4) is obtained.

$$\frac{V_o^2}{2g} = \frac{P2 - P3}{\rho g} + H - \Delta P \quad \text{[Formula 4]}$$

As found from the formula (4), below methods are considered so as to raise the collecting speed for collecting the foreign material.

(1) To increase the pressure difference between P2 and P3, namely to lower the pressure P3 when P2 is fixed. (from the first term in the right-hand side)

(2) To increase the head difference H (from the second term in the right-hand side)

(3) To lower the pressure loss in the collecting pipeline (from the third term in the right-hand side)

Consequently, in the present embodiment, the collecting speed for collecting the foreign material is raised by means of a synergistic effect of the aforementioned methods, (1) through (3).

Firstly, so as to secure the head difference H, a construction is formed such that a height position of the upper end of the collecting container 9 is placed to be lower than the bottom surface of the accumulator 8. Further, a further large collecting speed can be obtained by means of maximizing the height position difference as long as a limitation of disposition of a device construction allows.

Secondary, in the present embodiment, so as to minimize the pressure loss in the collecting pipeline, a diameter of the pipeline of the collecting pipeline 24*a* is formed as large as possible, and the length is formed as short as possible. The type of intervening valves having as small pressure loss coefficient as possible are selected.

Thirdly, a suction effect by means of the static pressure difference is increased by means of lowering the static pressure P1 (≈P3) by forming the inner diameter of the front suction pipe of accumulator 27 at the interflow portion of degasing pipe 26 to be smaller than that of the back and forth thereof, as in the present embodiment.

Incidentally, in the formula (4), when the difference between the static pressures (P2-P3) is replaced by (P2-P4), a formula in a case that the degassing pipe 25 is connected to the outlet side of the accumulator is obtained. In this case, pressure losses due to a friction loss of the pipeline, and the like are caused while moving from P2 to P4. When the circulating amount of the refrigerant in the main refrigerant circuit is large, the difference of the pressure (P2-P4) due to the pressure loss is increased to be sufficient to secure the collecting speed, and an interflow portion of a portion of P4 in the drawing is not required to be throttled. Accordingly, it becomes possible to secure the collecting speed without using a device such as throttling of the pipeline, when the degassing pipe 25 is returned to a downstream side of the accumulator 8.

On the other hand, in a case that the degassing pipe 25 is returned to the portion in front of the accumulator 8 without throttling the interflow portion of degassing pipe 26, ordinarily, since P1 (≈P3) becomes P1 (≈P3)>P2, due to a pipeline loss and the pressure loss due to a rapid expansion in the accumulator 8, the suction force for collecting the foreign material is not obtained only by means of the static pressure, and this forms a resistance, instead. Accordingly, when the head difference H is not obtained in large amount, it becomes impossible to perform the collecting operation for the foreign material. In the present embodiment, this problem is solved by generating the suction force by means of returning the degassing pipe 25 to a portion where the static pressure is lowered by throttling a part of the front suction pipe of accumulator 27, as described above.

Incidentally, in a case that the degassing pipe 25 is returned to a downstream side of the accumulator 8, there is a possibility that the foreign material directly returns to the compressor 1, while the collecting container 9 overflows in a case that a great amount of liquid refrigerant temporarily returns, or the like, in a transient condition of operation. In a case that the foreign material returns to the compressor 1, a collecting operation becomes impossible and a large-scale of repair, such as replacement of the compressor 1 is required to be performed.

Consequently, in the present embodiment, there is no possibility that the foreign material returns to the compressor 1 even when the collecting container 9 overflows by any remote chance due to that the degassing pipe 25 is returned to the portion in front of the accumulator 8. Therefore, a high safety can be secured.

Figure 5:
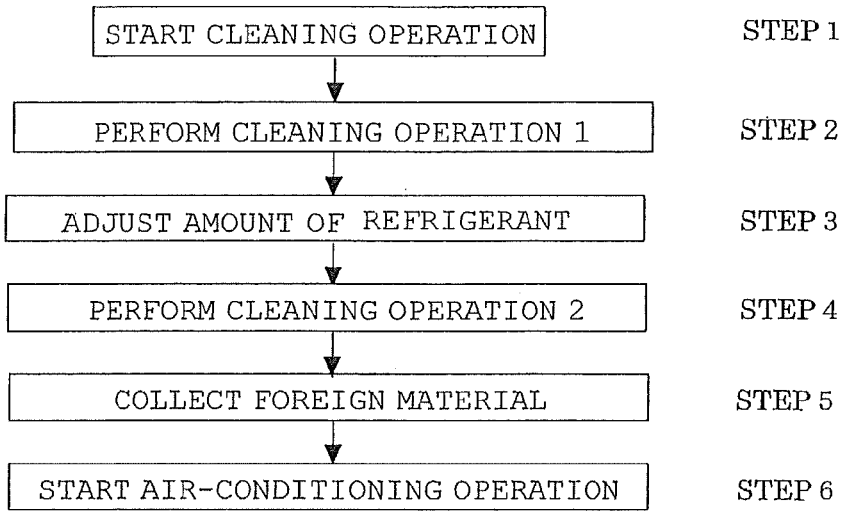
FIG. 5 is a view showing a work flow according to the first embodiment with respect to the present invention.

Next, a flow until an air-conditioning operation is started after performing a construction of the unit at an actual place will be explained on the basis of FIG. 5. In STEP 1 after performing the construction, an operation is started by a start switch (not shown) provided in outdoor equipment or indoor equipment of the unit. At this moment, until a sequence of cleaning operation is completed, even when a remote controller (not shown) for control is erroneously operated, the compressor 1 is held not to be rotated. Further, when the remote controller is operated in a case that the sequence of cleaning operation is not completed, the cleaning operation may be automatically started.

In STEP 2, the compressor 1 is started-up and a cleaning operation 1 is started. An operation in a case of operating a cooling cycle will be explained here. When the compressor 1 is operated, the gas refrigerant at high temperature and high pressure separates the refrigerating machine oil that is taken out from the compressor 1 in the oil separator 10, and the refrigerant gas is condensed-and-liquefied in the heat-source side heat exchange device 3 via the four-way valve 2. The refrigerating machine oil separated in the oil separator 10 flows in the suction pipeline of the compressor 1 via the capillary tube for oil return 18*a*, and returns to the compressor 1 together with the refrigerant. The refrigerant condensed in the heat-source side heat exchange device 3 is brought to be a liquid or a gas-liquid two-phase refrigerant at low dryness. The gas-liquid two-phase refrigerant is throttled into medium pressure by means of the pressure-adjusting valve 12. Here, the pressure-adjusting valve 12 controls the pressure to be lower than the withstanding pressure of the existing pipeline. The gas-liquid two-phase refrigerant at medium pressure or liquid single-phase refrigerant flows through the liquid-refrigerant pipeline 13 and is throttled up to low pressure at throttling devices, 5*a* and 5*b*. In the load side heat exchange devices, 6*a* and 6*b*, the gas-liquid two-phase refrigerant at low pressure draws heat from the periphery to perform cooling, and the gas-liquid two-phase refrigerant itself evaporates, becomes a gas-refrigerant, and flows in the gas refrigerant pipeline 14. The refrigerant that has flowed in the gas refrigerant pipeline 14 enters into the accumulator 8 together with a foreign material in the form of a liquid such as mineral oil through the four-way valve 2. In the accumulator 8, the refrigerant gas and the foreign material are separated and the refrigerant gas returns to the compressor 1, and the foreign material in the form of a liquid is accumulated in the accumulator 8.

Figure 6:
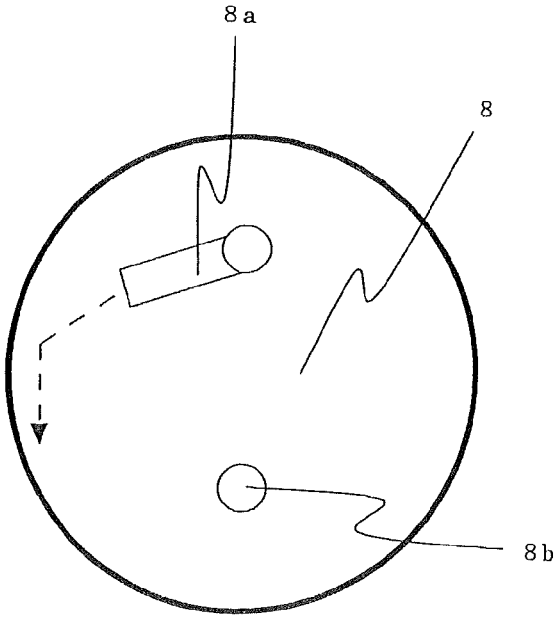
FIG. 6 is a view showing a flow in a horizontal direction in an accumulator according to the first embodiment with respect to the present invention.

In the accumulator 8, as described above, a structure of the accumulator inlet pipe 8*a* is constructed such that the refrigerant gas blows out along a horizontal direction of the internal wall of the accumulator. Accordingly, as shown in FIG. 6, in the accumulator 8, the gas-refrigerant and the foreign material are separated at high efficiency by means of a cyclone effect, in which the foreign material in the form of a liquid collides with a wall surface by means of centrifugal force, and the gas refrigerant and the foreign material are separated. Further, by means of forming a shell diameter of the accumulator 8 to be increased so as for the foreign material in the form of a liquid being miniaturized in the accumulator 8 to be settled out by attraction of gravity, and not to move up riding the gas-current speed, further large separation efficiency can be obtained. Accordingly, a disadvantage that the foreign material flows out from the accumulator 8, while riding the flow of the gas cooing medium, and reaches the compressor 1, resulting in being mixed in the new refrigerating machine oil can be avoided. Further, in the cleaning operation, the flow amount adjusting valve 21*a* provided below the accumulator 8, and the electromagnetic valve 15*c* provided in the degassing pipe 25 are closed, and there is no flow of the foreign material, the refrigerant, or the like toward the collecting container 9, and completely closed. Incidentally, the flow amount adjusting valve 21*a* and the electromagnetic valve 15*c* are opened only at a time of the collecting operation for the foreign material, and in an operating condition other than the above, the valves are closed. Furthermore, the ball valves, 22*a* and 22*b*, are opened, and this is an initialization at a time of shipping. Moreover, the flow amount adjusting valve 21*b* for oil return provided at the oil return pipeline 24*b* is closed from STEP 1 until STEP 5 is completed, and there is no possibility that the foreign material returns to the compressor 1 via the oil return pipeline 24*b*.

A superheat of the gas refrigerant that flows into the accumulator 8 is calculated from an output of the pressure sensor 16 and the temperature sensor 17 (superheat=temperature of gas refrigerant−saturation temperature of pressure), and is controlled by means of calculating and comparing a difference between a superheat calculation value and an superheat target value, and thereby varying an opening extent of the throttling devices, 5*a* and 5*b* to be within a range of a target superheat. Incidentally, the aforementioned calculation processing and the control processing are performed by means of a microcomputer (not shown) or the like housed in the heat-source side unit 100. The target superheat is, for example, 10 degrees in Celsius, and at least the superheat of the gas refrigerant flowing into the accumulator 8 is configured to be kept in a plus-area. As described above, by means of properly controlling the superheat of the refrigerant at a portion in front of the accumulator, the liquid refrigerant is not mixed in the refrigerant flowing into the accumulator 8, and there is no possibility that the liquid refrigerant is accumulated in the accumulator 8.

When the liquid refrigerant is accumulated in the accumulator 8, the liquid refrigerant is collected together at the time when the foreign material is collected in STEP 5, described later, and thereby an amount of the refrigerant in the refrigerating circuit varies. Therefore, there is a possibility that a bad influence such as lowering of the air-conditioning capability occurs. Accordingly, an operation is required to be configured for the liquid refrigerant not to return into the accumulator 8, in the cleaning operation. Further, there is a method for measuring a compressor suction superheat by means of measuring the temperature at the exist side of the accumulator 8, however in this method, in a case that a liquid refrigerant returns to the accumulator 8 at a time of start-up or the like, even though a superheat is detected at the inlet of the accumulator 8, the condition is measured to be close to a condition being saturated at the outlet thereof (because the liquid is evaporated from the accumulator 8). Accordingly, the superheat at the inlet of the accumulator 8 is not correctly detected, and there is a possibility that the liquid refrigerant is mixed in. Consequently, by means of proving the temperature sensor 17 at the inlet of the accumulator 8 as in the present embodiment, an operation in which the liquid refrigerant does not return to the accumulator 8 can assuredly be performed.

Incidentally, a construction for evaporating the liquid-refrigerant earlier even in a case when the liquid refrigerant is mixed into inside of the accumulator 8, by means of performing an exterior packaging by wrapping a heater (not shown) around an outer periphery of the accumulator 8, or housing (inner packaging) a heater in the accumulator 8, and turning on the electricity and heating, may be applied. Further, by means of performing the exterior packaging by wrapping a heater (not shown) around the collecting container 9, or housing the heater, the liquid-refrigerant can completely be removed by turning on the electricity and heating the heater, even in a case when the liquid refrigerant is mixed into the collecting container 9. Thereby, the refrigerant required for the main circuit of the refrigerating cycle can assuredly be secured.

Furthermore, it is also possible to introduce a gas refrigerant at high temperature, which is discharged from the compressor 1, into the accumulator 8 by means of opening the bypass electromagnetic valve 30 shown in FIG. 1. An operation in which the liquid refrigerant is evaporated and dried earlier, by heating the inside of the accumulator 8 by means of high temperature gas may be performed.

In STEP 3, an adjustment for an amount of the refrigerant is performed. In the adjustment for the amount of the refrigerant, a refrigerant is added from a refrigerant-filling port, and it is detected that an outlet SC of the condenser and an outlet SH of an evaporator in the refrigerating cycle have reached a predetermined valve. Then, STEP 3 is finished and the process proceeds to STEP 4. Further, in a case that the filling operation for the refrigerant is not brought to be proper for a predetermined time or more, driving operations of the heat-source side unit 100 and the load-side unit 200 is stopped and a time over warning is reported to the outside. At this moment, a proper amount of the refrigerant is judged to be proper when either one of two set criteria of, an amount of the refrigerant necessary for performing an ordinary air-conditioning operation, or an amount of the refrigerant necessary for continuing the cleaning operation, is satisfied. However, in a case that although the amount of the refrigerant necessary for continuing the cleaning operation is satisfied, the amount of the refrigerant necessary for performing the ordinary air-conditioning operation is not satisfied, the fact that the adjustment for the amount of the refrigerant is required to be again performed is reported to the outside after the sequential cleaning operation is performed.

In STEP 4, a cleaning operation 2 is performed. Although an operating action is approximately the same as that in STEP 2, the compressor 1 may be operated with an operating frequency at a maximum capacity so as to quickly complete the cleaning operation. This operation is performed for a predetermined time, STEP 4 is terminated, and collecting operation for the foreign material is performed upon making the shift to STEP 5.

In STEP 5, the flow amount-adjusting valve 21*a* and the electromagnetic valve 15*c*, being closed in the past STEPs, are opened, and the foreign material accumulated in the accumulator 8 moves to the collecting container 9. In the present embodiment, as described above, since the collecting speed for collecting the foreign material is raised by means of utilizing the head difference, the suction effect through the degassing pipe 25, and the like, the collecting operation for the foreign material can be completed in a short time. The collecting time for the foreign material largely depends on a viscosity of oil as a main component of the foreign material, and can be predicted from the ambient air temperature. By means of setting the collecting time by making an allowance of, for example, 1.5 times or the like, for the predicting time, the foreign material in the accumulator 8 can completely be moved to the collecting container 9.

Further, in STEP 5, the flow amount adjusting valve 21*a* and the electromagnetic valve 15*c* are once closed in a condition in which pressure in the collecting container 9 is kept low. In this condition, the bypass electromagnetic valve 30 (in FIG. 1) is opened, and thereby the discharge gas at high pressure is introduced to the accumulator 8, resulting in raising the pressure at the accumulator 8 side. Thereby, a pressure difference is generated between the accumulator 8 (high pressure) and the collecting container 9 (low pressure). In addition, by means of opening the flow amount adjusting valve 21*a* next, it also becomes possible to increase the collecting speed for collecting the foreign material utilizing the generated pressure difference.

Furthermore, in STEP 5, it is also possible to increase the collecting speed for collecting the foreign material, utilizing the pressure difference between the accumulator 8 and the collecting container 9, which is generated by means of that pressure adjusting valves (5*a* and 5*b*, in a case of cooling operation, and 12, in a case of heating operation) are once closed, and the pressure in a low-pressure side including the accumulator 8 is thereby lowered, and that the pressure in the collecting container 9 is kept low by means of closing the flow amount adjusting valve 21*a* and the electromagnetic valve 15*c* in this condition, and that the pressure adjusting valves (5*a* and 5*b*, in a case of cooling operation, and 12, in a case of heating operation) are opened next, to recover the pressure at the low-pressure side including the accumulator 8 into the pressure higher than the pressure in the collecting container 9.

In a case that the set collecting time is terminated, the flow amount adjusting valve 21*a* and the electromagnetic valve 15*c* are closed, and the foreign material-collecting operation is completed.

In STEP 6, an ordinary air-conditioning operation is started. At this time, by means of opening the electromagnetic valve 15*c*, the refrigerating machine oil for the new refrigerant accumulated in the oil tank 11 before shipping flows to the suction pipeline of the compressor, and returns to the compressor 1 together with refrigerant gas.

As described above, by means of providing the oil tank 11 for accumulating the refrigerating machine oil for the new refrigerant separately from the main refrigerant circuit, it becomes possible to rapidly return the refrigerating machine oil for use in the new refrigerant to be collected to the accumulator 8 together with the foreign material during the cleaning operation, into the main refrigerant circuit after the cleaning operation. Further, in a case of the hitherto known method in which redundant oil for the refrigerating machine oil for use in the new refrigerant that is taken out in a large amount at the time of start-up is previously accumulated in the main refrigerant circuit, making the shift to the collecting operation for the foreign material is impossible during the time until the redundant oil returns to the compressor 1 (because the redundant oil is also collected together with the foreign material). However, when the oil tank 11 is separately provided as in the present embodiment, the collecting operation for the foreign material can be performed immediately after the operation is started, and therefore, the time of construction can be shortened.

At this moment, a method for filling the oil amount taken out into the refrigerant circuit from the compressor 1 during the cleaning operation, to the oil tank 11 before shipping will be explained. When the electromagnetic valve 15*a* is opened in a condition that a dummy heat exchange device is connected to the liquid side ball valve 4 of the heat-source side unit 100 and the gas-side ball valve 7, or that a triangular operation is performed by shunting the liquid-side ball valve 4 and the gas-side ball valve 7, and the compressor 1 is started, while closing the electromagnetic valve 15*b*, the refrigerating machine oil taken out from the compressor 1 is separated in the oil separator 10 and enters into the oil tank 11. The refrigerant gas and the refrigerating machine oil are separated in the oil tank 11, the refrigerating machine oil is accumulated in the oil tank 11, and the refrigerant gas returns to the suction side of the compressor via the electromagnetic valve 15*a*. By means of continuing this operation for a certain time, the refrigerating air-conditioning apparatus is shipped in a condition of accumulating the refrigerating machine oil in the oil tank 11, and closing the electromagnetic valves, 15*a* and 15*b*.

Incidentally, it is also possible to form a condition in which the collecting container 9 is completely closed to the refrigerating cycle circuit by means of manually closing the ball valves 22*a* and 22*b*, after completion of the aforementioned STEP 1 through STEP 6. Further, it is also possible to remove the collecting container 9 itself from the heat-source side unit 100 by means of detaching the collecting container 9 from the ball valves 22*a* and 22*b*.

In the ordinary air-conditioning operation in STEP 6 or later, an amount of oil in the compressor 1 is always properly maintained by means of performing an oil return operation for returning the refrigerating machine oil to the compressor 1 by opening the flow amount adjusting valve 21*b* in an oil return circuit. An opening extent of the flow amount adjusting valve 21*b* is properly controlled so that an amount of oil corresponding to an operating condition such as an operating frequency of the compressor is returned. Further, since the oil return circuit is returned to a downstream side of the accumulator 8, a static pressure of the rear suction pipe of accumulator 28 and the oil return pipeline 24*b* is lower than that in the accumulator 8 due to a pipeline pressure loss as described above, and suction force is generated. Thereby, collecting operation for the oil is brought to be possible.

Furthermore, an accumulator oil return mechanism in the present embodiment has a construction, in which a hitherto frequently used open-hole type U-shaped pipe is not used, the gas refrigerant is returned from above the accumulator 8, and the oil is returned from the bottom surface of the accumulator 8 via the flow amount adjusting valve 21*b*. Accordingly, when the flow amount adjusting valve 21*b* is fully closed, there is no possibility that the oil or the liquid accumulated in the accumulator 8 is returned, and since the flow amount adjusting valve 21*b* is closed in the above-described STEP 1 through STEP 5, there is no possibility that a disadvantage, in which the foreign material collected in the accumulator 8 returns to the compressor 1, occurs.

Incidentally, although in an example of operation in the aforementioned STEP 1 through STEP 6, an explanation is made taking the cooling operation as an example, a similar separating operation for the foreign material by means of the accumulator 8, and the collecting operation to the collecting container 9 can be performed for the heating operation.

Second Embodiment

Figure 7:
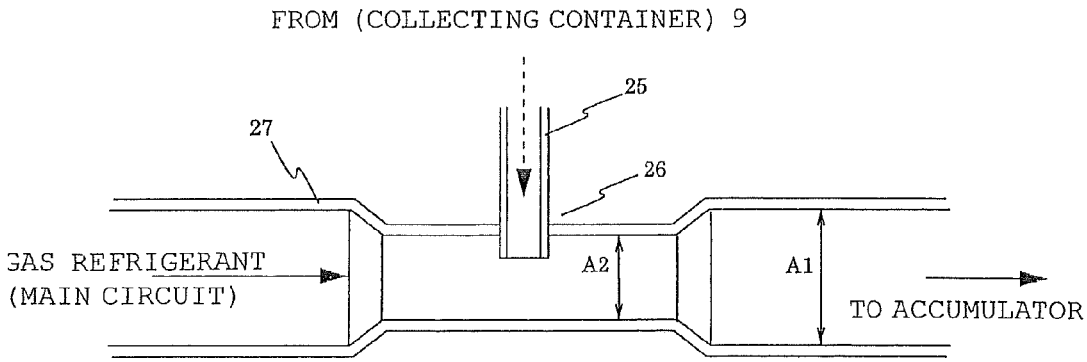
FIG. 7 is a cross-section (part-1) showing a part of the refrigerant circuit of the refrigerating air-conditioning apparatus according to a second embodiment with respect to the present invention.

FIG. 7 is a cross-section showing a part of refrigerant circuit of a refrigerating air-conditioning apparatus according to the second embodiment with respect to the present invention. One end of the degassing pipe 25 is connected to the collecting container 9, while the other end thereof is protruded out to an inside of a low-pressure side main refrigerant circuit pipeline (in this example shown in the drawing, a front suction pipe of accumulator 27) from the four-way valve 2 of the heat-source side unit 100 to the suction side of the compressor 1, and connected thereto. The construction other than the above-described is similar to that of the first embodiment, and therefore explanation is omitted.

When performing the collecting operation for the foreign material from the accumulator 8 to the collecting container 9, as shown in the first embodiment, the foreign material moves by means of a pressure difference between the accumulator 8 and the main refrigerant circuit pipeline to which the degassing pipe 25 is connected, and an action of its own weight. In the main refrigerant circuit pipeline, the refrigerant gas flows and the end portion of the degassing pipe 25 protruded out is exposed to the flow of the gas-refrigerant.

In general, it is known that in the vicinity of a surface of a material body, such as a cylinder, or the like that is placed in a flow, an area where the static pressure significantly lowers occurs at a downstream side, except a part at an upstream side where a static pressure rises more than that in a periphery. The present embodiment is the one in which the phenomenon is skillfully utilized. That is, the suction force is increased by means of generating a large static pressure drop around the degassing pipe 25. Thereby, the collecting speed for collecting the foreign material can be increased. In general, a diameter of the degassing pipe 25 is small compared to a diameter of the main refrigerant circuit pipeline, and a reduction rate of a flow path cross-section area in the main refrigerant circuit pipeline due to the protruded-out degassing pipe 25 is small.

Therefore, an increase of the pressure loss of the gas refrigerant does not practically exist. As a result, lowering of capability due to lowering of a circulating amount of the refrigerant is small.

An amount of static pressure drop is proportional to dynamical pressure of the flow, namely the square of the current velocity of the gas refrigerant colliding with an end portion of the degassing pipe 25 that is protruded out. In an area of a practical operation, the flow of the refrigerant gas in the main refrigerant circuit pipeline is in approximately a turbulent flow condition, and in this case, the current velocity in the pipe has a distribution in a radial direction. This current velocity distribution is expressed by a distribution that increases, for example, by a distance measured from a pipe wall, to the power of 1/7, and reaches the maximum at an axis of the pipe, namely a so-called law of one-seventh power. This distribution is divided into an area in which a distance measured from the pipe wall is 10 to 20% of the radius of the pipe where the current velocity is relatively small and an area other than that where the current velocity is large and relatively uniform. Accordingly, when a tip end of the degassing pipe 25 is protruded out up to the area of the latter, a stable suction force can be obtained. However, since the more the protruding-out length of the degassing pipe 25 increases, the more the reduction rate of the flow path cross-section area in the main refrigerant circuit pipeline increases, particularly, in a case that a diameter of the degassing pipe 25 is relatively large, or the like, the circulating amount of the refrigerant is lowered. Consequently, an optimal position of the tip end of the protruded-out degassing pipe 25 exists in an area between a position, at which a distance measured from the pipe wall in a radial direction is 10 to 20% of the pipe radius, and the axis of the pipe.

Figure 8:
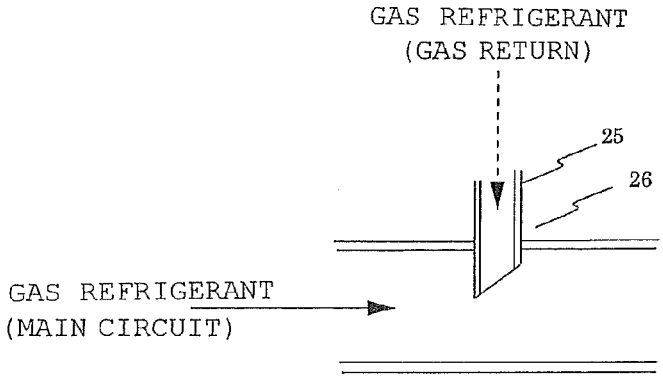
FIG. 8 is a cross-section (part-2) showing a part of the refrigerant circuit of the refrigerating air-conditioning apparatus according to the second embodiment with respect to the present invention.

Further, FIG. 8 is a cross-section showing a case in which in the degassing pipe 25, an opening portion of an end portion to be connected to the low-pressure side main refrigerant circuit pipeline is provided with a slanting tip end shape in a manner so as to face the downstream side. By constructing as described above, in manufacturing, even if the degassing pipe 25 is attached in a slanting manner in connecting the degassing pipe 25 to the low-pressure side main refrigerant circuit pipeline, there is no possibility that the opening portion faces the upstream side, and an assembling work is easy. Further, stable suction force having less fluctuation can be generated. Incidentally, when the opening portion of the aforementioned end portion of the degassing pipe 25 is attached to be slanted toward the upstream side, the suction force is lowered by receiving an influence of the dynamic force of the flow. Consequently, at a time of attaching the degassing pipe 25, it is required to pay attention to the attaching angle. In the construction shown in FIG. 8, even in a case that an attaching accuracy is low and the opening portion of the aforementioned end portion is attached to be slanted toward the upstream side, a stable suction force can be obtained.

Figure 9:
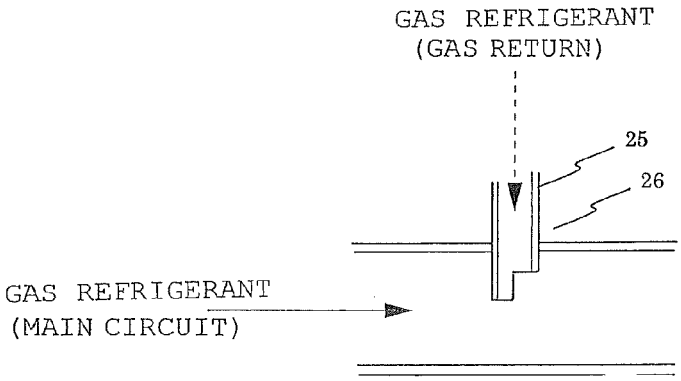
FIG. 9 is a cross-section (part-3) showing a part of the refrigerant circuit of the refrigerating air-conditioning apparatus according to the second embodiment with respect to the present invention.

In addition, in the construction shown in FIG. 8, since an opening area of the degassing pipe 25 can be increased, a degassing in the collecting container 9 at the time of the collecting operation for collecting the foreign material is promoted, and the lowering of the suction force due to an internal pressure rise in the collecting container 9 can be suppressed. Incidentally, as shown in FIG. 9, the downstream side of the tip end of the protruded-out degassing pipe 25 may be cut so that the opening portion faces the downstream side.

Further, even when a part of the protruded-out degassing pipe 25 is bent, unless the opening portion thereof faces the upstream side, a static pressure drop is generated around the opening portion, so that the suction force is obtained.

Furthermore, it is preferable to provide the opening portion of the protruded-out degassing pipe 25 at a place where the largest static pressure drop can be obtained, which exists between a front face and a back face facing the flow.

Moreover, when an inner diameter of a portion of the low-pressure side main refrigerant circuit pipeline, to which the degassing pipe 25 is connected, is throttled more than an inner diameter of the front and rear portions thereof, the dynamic pressure is increased by means of increase of the current velocity, and far large static pressure drop is generated, resulting in increase of the suction forth.

Since the suction force at the collecting operation for collecting the foreign material from the accumulator 8 to the collecting container 9 can be enlarged by means of constructing the end portion of the degassing pipe 25 to be connected to the main refrigerant pipeline, as in the aforementioned explanation, the collecting speed for the foreign material can be enlarged. As a result, it becomes possible to complete the collecting operation for the foreign material in a short time, and the time required for the process of operation can be reduced. Further, even in a case that the viscosity of the oil as a main component of the foreign material is lowered due to a low outdoor air temperature, it becomes possible to perform the collecting operation in a short time by means of the strong suction force.

What is claimed is:

1. A refrigerating air-conditioning apparatus constructed by connecting a heat-source side unit and a load-side unit with an existing refrigerant pipeline, wherein the heat source side unit comprises:

a compressor;

an accumulator connected to a suction side of the compressor, the accumulator having a function to separate and collect a foreign material in an existing pipeline;

a collecting container for collecting the foreign material separated by the accumulator;

a collecting pipeline that connects a bottom portion of the accumulator and the collecting container;

an oil return pipeline configured to return refrigerating machine oil to the compressor, the oil return pipeline branches from the collecting pipeline at a position downwardly of the accumulator in a vertical direction and joins with a pipeline between the accumulator and the suction side of the compressor via flow amount adjusting means; and a degassing pipe connecting a low-pressure side main refrigerant circuit pipeline extending from a four-way valve of the heat-source side unit to a compressor-suction side and the collecting container, wherein an end portion of the degassing pipe being connected to the low-pressure side main refrigerant circuit pipeline protrudes into and through an inner surface of the low-pressure side main refrigerant circuit pipeline, and wherein at a time of ordinary cooling or heating operation, the refrigerating machine oil is made to flow into the oil return pipeline, and at a time of pipeline cleaning and foreign material-collecting operations, the flow amount adjusting means is fully closed.

2. The refrigerating air-conditioning apparatus according to claim 1, wherein the end portion of the degassing pipe comprises a tip end shape for an opening portion thereof to face a downstream side.

3. The refrigerating air-conditioning apparatus according to claim 1, wherein the portion of the low-pressure side main refrigerant circuit pipeline where the degassing pipe is connected thereto has an inner diameter being throttled to have a diameter less than a diameter of front and rear portions thereof.

4. The refrigerating air-conditioning apparatus according to claim 1, wherein an oil separator is provided at a high-pressure side of the heat-source side unit, and wherein an oil tank is provided in a middle of a pipeline for oil return, connecting the oil separator and the compressor of the heat-source side unit.

5. The refrigerating air-conditioning apparatus according to claim 1, wherein an electric operation-type opening and closing valve is provided in a pipeline for connecting the collecting container and a component of the heat-source side unit.

6. The refrigerating air-conditioning apparatus according to claim 1, wherein a manual opening and closing valve is provided in a pipeline for connecting the collecting container and a component of the heat-source side unit.

7. The refrigerating air-conditioning apparatus according to claim 1, wherein a pressure escape valve is provided in a pipeline for connecting the collecting container and a component of the heat-source side unit.

8. The refrigerating air-conditioning apparatus according to claim 1, wherein the accumulator or the collecting container is sheathed or internally equipped with a heater.

* * * * *